United States Patent [19]

Woodruff

[11] 4,086,869

[45] May 2, 1978

[54] BOAT TRIM ADJUSTING APPARATUS

[76] Inventor: James Edward Woodruff, 3057 Reese Dr., Portsmouth, Va. 23703

[21] Appl. No.: 766,547

[22] Filed: Feb. 7, 1977

[51] Int. Cl.[2] ..... B63H 5/12

[52] U.S. Cl. ..... 115/41 HT; 115/41 R; 248/4

[58] Field of Search ..... 115/41 R, 47 HT, 17; 248/4

[56] References Cited

U.S. PATENT DOCUMENTS

| | | | |
|---|---|---|---|
| 2,966,876 | 1/1961 | MacWilliam | 115/41 R |
| 3,116,710 | 1/1964 | Cass | 115/41 R |
| 3,250,240 | 5/1966 | Ziegler | 115/41 HT |
| 3,376,842 | 4/1968 | Wynne | 115/41 R |

*Primary Examiner*—Trygve M. Blix
*Assistant Examiner*—Stuart M. Goldstein
*Attorney, Agent, or Firm*—Jacobi, Lilling & Siegel

[57] ABSTRACT

Boat trim adjusting apparatus generally comprising a bracket of generally U-shaped configuration pivotally mounted on a support frame secured to the rear of the boat. The bracket comprises a lower transversely extending base portion and a pair of arms extending upwardly and outwardly from the base portion and terminating at their upper ends in rearwardly extending wing portions. A rod is mounted on and extends transversely across the arms above the base portion and is adapted to be received in recesses in a pivotable mounting bracket for the engine having releasable locking means for engaging the rod. Suitable power means, such as hydraulic piston and cylinder units, are secured to the rear end portion of the wing portions and to support plates secured to the rear of the boat for selectively pivoting the adjusting bracket relative to the boat. In this manner, the engine mounting bracket is also pivoted to enable the trim of the boat to be adjusted while it is stationary or in motion.

7 Claims, 6 Drawing Figures

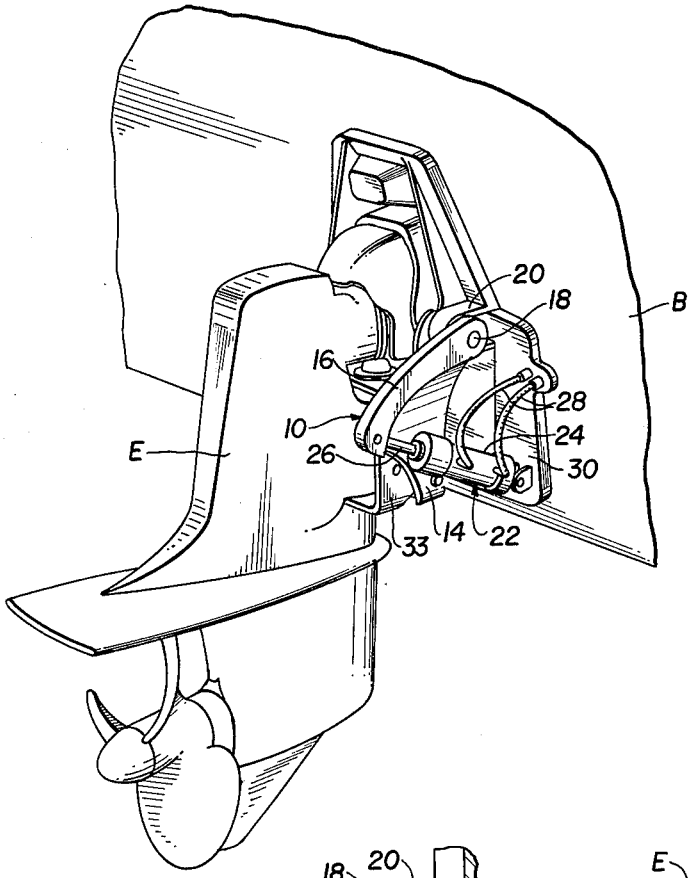
FIG.1
FIG.4
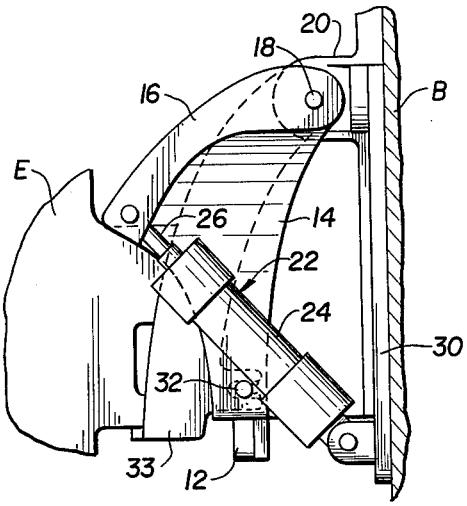
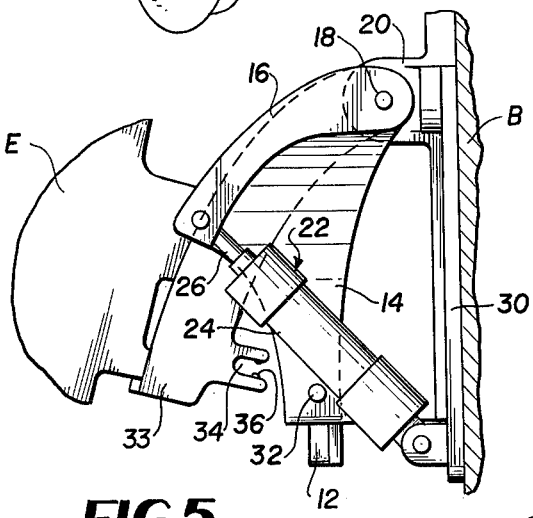
FIG.5
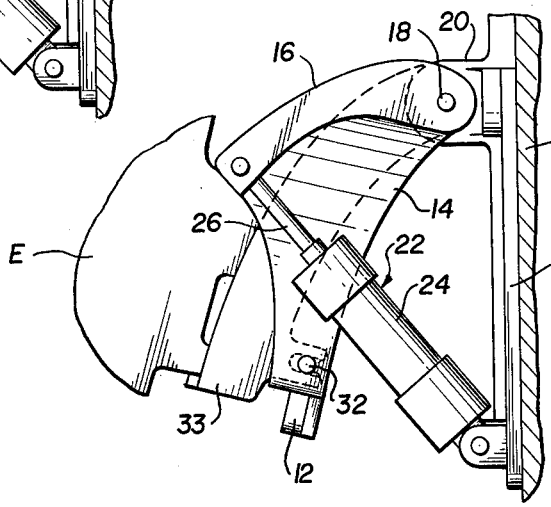
FIG.6

BOAT TRIM ADJUSTING APPARATUS

BACKGROUND OF THE INVENTION

This invention relates generally to boat trim adjusting apparatus and, more particularly, to a boat trim adjusting bracket that is engageable with a mounting bracket for the rear portion or out drive of the boat engine to pivot the mounting bracket and rear portion of the engine so that the trim of the boat may be adjusted while it is stationary or in motion.

In many power boats, such as those having inboard-outboard engines, it is not possible to adjust the elevation or angle of thrust of the engine while the boat is in motion. Accordingly, it is not possible to adjust the trim of the boat while it is in motion. If it is desired to adjust the trim of such boats, it has been necessary in the past to stop the boat and thereafter to manually adjust the angle of elevation of the rear portion of the engine which is pivotally mounted on the rear portion of the boat.

In a few cases where apparatus has been provided in power boats for adjusting the trim of the boat while in motion, such apparatus has been subject to one or more of the following disadvantages:

1. it has been complicated and expensive to manufacture; and/or
2. it has been difficult to install; and/or
3. it has been unreliable in operation; and/or
4. it has been difficult to operate.

Accordingly, a need has arisen for a simple and efficient means for adjusting the angle of elevation of the rear portion of an engine for a power boat to thereby adjust the trim of the boat while it is stationary or in motion. The adjusting apparatus of the present invention meets this need.

SUMMARY OF THE INVENTION

The present invention is a new and improved boat trim adjusting apparatus generally comprising a bracket of generally U-shaped configuration pivotally mounted on a support frame secured to the rear portion of the boat. The adjusting bracket comprises a lower transversely extending base portion and a pair of arms extending upwardly and outwadly from the base portion and terminating at their upper ends in rearwardly and laterally extending wing portions.

A rod is mounted on and extends transversely across the arms above the base portion and is adapted to be received in recesses in a pivotable mounting bracket for the rear portion of the engine having releasable locking means for engaging the rod. Suitable power means, such as hydraulic piston and cylinder units, are secured to the rear end portions of the wing portions and to support plates secured to the rear of the boat for enabling the adjusting bracket to be selectively pivoted relative to the boat. In this manner, the engine mounting bracket is also pivoted to change the angle of elevation of the engine, thereby enabling the trim of the boat to be adjusted while it is stationary or in motion.

In the event the rear or outboard portion of the engine strikes an object while the boat is in motion, the engine mounting bracket will separate from the rod on the adjusting bracket because of the release of the releasable locking means, thereby preventing damage to the engine or adjusting bracket.

BRIEF DESCRIPTION OF THE DRAWINGS

FIG. 1 is a perspective view showing the boat trim adjusting apparatus constructed in accordance with the principles of the present invention;

FIG. 4 is a side elevational view of the boat trim adjusting apparatus of the present invention, showing the adjusting bracket in an inner position adjacent the rear of the boat;

FIG. 5 is a side elevational view similar to FIG. 4, showing the adjusting bracket in the inner position adjacent the rear portion of the boat, with the mounting bracket for the engine removed therefrom; and FIG. 6 is a side elevational view similar to FIGS. 4 and 5, showing the adjusting bracket and engine mounting bracket in outer at elevated positions wherein they have been pivotally moved rearwadly from the rear portion of the boat.

DESCRIPTION OF THE PREFERRED EMBODIMENT

Figure 2:
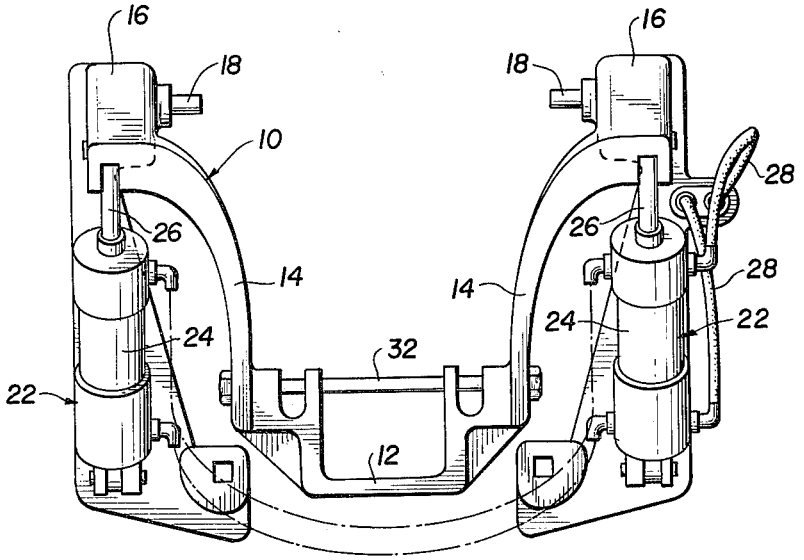
FIG. 2 is a rear elevational view of the boat trim adjusting apparatus of the present invention.
Figure 3:
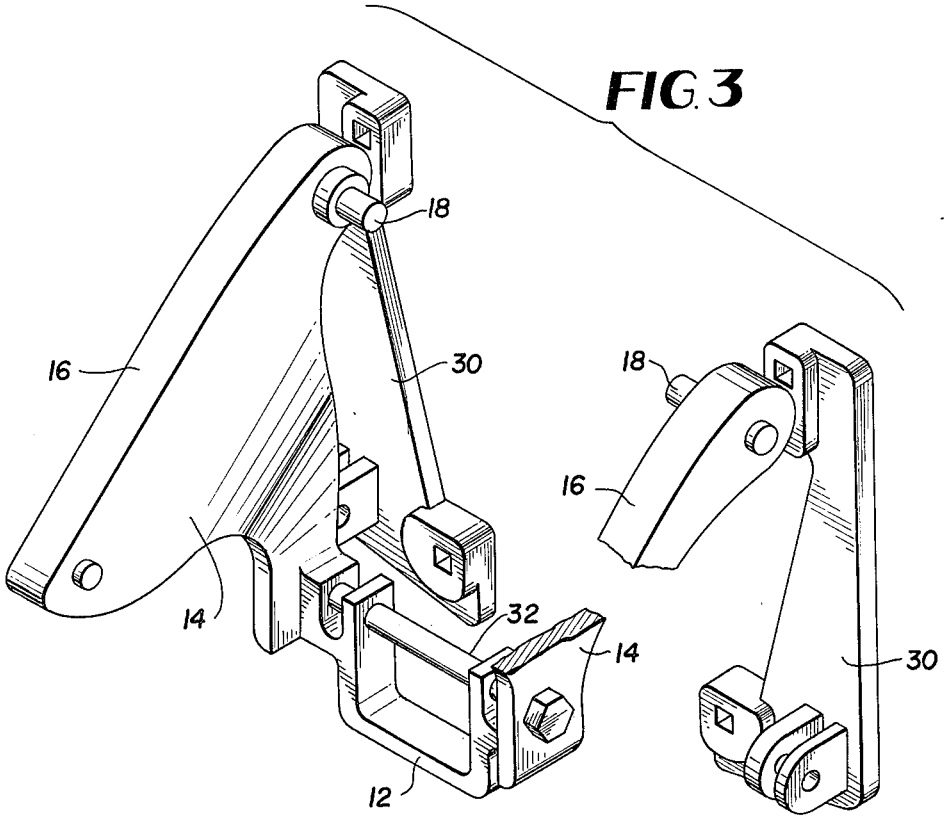
FIG. 3 is a perspective view, with parts broken away, of a portion of the boat trim adjusting apparatus of the present invention and the support plates to which it is connected.

As illustrated in FIGS. 1 through 3, the apparatus of the present invention generally comprises an adjusting bracket 10 of generally U-shaped configuration. The adjusting bracket 10 has a transversely extending base portion 12 and a pair of upwardly and outwardly extending arms 14, each terminating in a rearwardly and laterally outwardly extending wing portion 16. Preferably, the base portions 12, arms 14 and wing portions 16 are integrally formed from a suitable material, such as aluminum. Within the scope of the present invention, however, these components of the adjusting bracket 10 could be separately formed and secured together in any suitable manner.

The adjusting bracket 10 is pivotally mounted on the rear portion of the boat B by pivot pins 18 on the forward ends of the wing portions 16 that are rotatably mounted on adjacent portions of a support frame 20 mounted on the rear portion of the boat B. In this manner, the adjusting bracket 10 is pivotally movable in a clockwise and counterclockwise direction relative to the rear portion of the boat B about an axis defined by the pivot pins 18.

For the purpose of pivoting the adjusting bracket 10, power units of any suitable type may be provided, such as the hydraulic power units 22 shown in FIGS. 1 and 2, each having a cylinder 24 with a piston slidably mounted therein and a piston rod 26 extending rearwardly outwardly therefrom. Hydraulic lines 28 are connected to the cylinder 24 and to a suitable actuating means, such as a pump or the like (not shown) located within the boat B.

Each cylinder 24 is pivotally mounted at the forward end on a support plate 30 secured to the rear portion of the boat B. The support plate 30 may be formed integrally with or separate from the support frame 20 secured to the rear of the boat. At the rear end of the cylinder 24, the outer end of the piston rod 26 is pivotally connected to the rear end portion of the adjacent wing portion 16 of the arm 14 of the adjusting bracket 10. It will be readily seen, therefore, that by selective application of fluid to the cylinders 24 through the lines 28, the pistons and piston rods 26 may be moved to effect pivotal movement of the adjusting bracket 10 relative to the rear portion of the boat B.

As shown in FIGS. 2 and 3, the adjusting bracket 10 is provided with a transversely extending rod 32 disposed above the base portion 12 and extending between the arms 14. Preferably, the rod 32 extends through apertures in the arms 14 and is maintained therein by a nut or other suitable type of cap member mounted on the end thereof.

The specific embodiment of the adjusting bracket 10 shown in the drawings is especially adapted for use with a boat having an inboard-outboard engine like the VOLVO PENTA AQ 250, 270 and 280 models. With this type of engine, the rear portion E of the engine is mounted for pivotal movement on a generally U-shaped mounting bracket 33 which is pivotally mounted at its upper end of the support frame 20 secured to the rear portion of the boat B about an axis that is the same as the axis of rotation defined by the pivot pins 18 mounted on the wing portions 16 of the arms 14 of the adjusting bracket 10.

As shown in FIGS. 4 through 6, the mounting bracket 33 is provided with a plurality of forwardly opening recesses 34 which are adapted to receive the rod 32 therein. Releasable locking means 36 of any suitable construction are provided in each of the recesses 34 for the purpose of releasably maintaining The rod 32 within the recesses during normal travel of the boat B and engine E through the water, in the manner illustrated in FIGS. 4 and 6. If the rear engine portion E were to strike an object in the water, the rod 32 would be removed from the recesses 34 in the mounting bracket 33 owing to the releasable locking means 36, thereby preventing damage to the engine E or the adjusting bracket 10 and its associated components, in the manner shown in FIG. 5.

In the operation of the present invention, the actuation of the hydraulic power units 22 serves to pivotally move the adjusting bracket 10 about the axis of the pivot pins 18 relative to the boat B, and also serves to pivotally move the rear portion of the engine E owing to the releasable connection between the rod 32 on the adjusting bracket 10 and the recesses 34 and releasable locking means 36 on the mounting bracket 33 for the engine E. In this manner, the adjusting bracket 10, mounting bracket 33 and rear engine portion E may be moved between the positions shown in FIG. 4 and FIG. 6, depending on the movement of the piston rods 26 of the hydraulic power units 22, to vary the elevation and angle of thrust of the engine and thus the trim of the boat B.

It is noted that, although the specific embodiment of the adjusting bracket 10 shown in the drawings is especially adapted for use with the VOLVO PENTA 250, 270 and 280 inboard-outboard engines, it is within the scope of the present invention to make small modifications to the shape or dimensions of the adjusting bracket 10 so that it can be used with other engines that may have mounting brackets that differ somewhat from the VOLVO engine.

What is claimed is:

1. Apparatus for adjusting the elevation of an engine pivotally mounted on the rear portion of a boat to adjust the trim of the boat, said adjusting apparatus comprising:

an adjusting bracket of generally U-shaped configuration having a base portion and a pair of arms extending upwardly and outwardly from said base portion, each of said arms increasing in width as it extends upwardly, the upper forward end of each arm being pivotally connected to the rear portion of the boat to enable said adjusting bracket to be pivoted relative to the boat, each of said arms having a rearwardly and laterally outwardly extending wing portion, means connecting said adjusting bracket to the engine, and means connected to the boat and to the rear end of said wing portions (said arms) for selectively pivotally moving said adjusting bracket and the engine connected thereto to vary the elevation of the engine and adjust the trim of the boat.

2. The apparatus of claim 1 wherein said connecting means comprises a mounting bracket secured to the engine and pivotally mounted on the rear portion of the boat, and means for releasably engaging said adjusting bracket.

3. The apparatus of claim 2 wherein said adjusting bracket comprises a substantially transverse rod, and said engaging means comprises a plurality of recesses in said mounting bracket adapted to receive said rod therein and releasable locking means in said recesses for engaging said rod and releasably retaining it in said recesses.

4. The apparatus of claim 3 wherein said rod is positioned above said base portion.

5. The apparatus of claim 1 wherein said moving means comprises a power unit connected to the rear end of each of said wing portions.

6. The apparatus of claim 5 wherein each power unit comprises a hydraulic piston and cylinder unit having a piston rod extending rearwardly from one end of the cylinder and pivotally connected to the rear end of the adjacent wing portion.

7. The apparatus of claim 1 wherein said base portion, said arms and said wing portions are integrally formed of aluminum.

* * * * *